US007617875B2

(12) United States Patent
Darnell et al.

(10) Patent No.: US 7,617,875 B2
(45) Date of Patent: Nov. 17, 2009

(54) SHIFTING APPARATUS AND METHOD

(75) Inventors: William J. Darnell, Houston, TX (US); Bryan Lane, Houston, TX (US); William Tyler Livingston, New Iberia, LA (US); Andrew Wee-Mien Wong, Lafayette, LA (US)

(73) Assignee: PetroQuip Energy Services, LLP, Houston, TX (US)

( * ) Notice: Subject to any disclaimer, the term of this patent is extended or adjusted under 35 U.S.C. 154(b) by 284 days.

(21) Appl. No.: 11/788,818

(22) Filed: Apr. 20, 2007

(65) Prior Publication Data

US 2008/0257558 A1 Oct. 23, 2008

(51) Int. Cl.
*E21B 34/14* (2006.01)
*E21B 34/12* (2006.01)

(52) U.S. Cl. ..... 166/373; 166/334.1

(58) Field of Classification Search ..... 166/373, 166/319, 323, 332.4, 334.1
See application file for complete search history.

(56) References Cited

U.S. PATENT DOCUMENTS 3,896,876 A * 7/1975 Crowe ..... 166/322
4,716,963 A * 1/1988 George et al. ..... 166/123
4,880,056 A * 11/1989 Nelson et al. ..... 166/51
5,156,207 A * 10/1992 Haugen et al. ..... 166/142
6,397,949 B1 6/2002 Walker et al.
6,659,186 B2 * 12/2003 Patel ..... 166/386
7,152,678 B2 12/2006 Turner et al.
7,290,617 B2 * 11/2007 Popilian et al. ..... 166/386
7,322,417 B2 * 1/2008 Rytlewski et al. ..... 166/313
2005/0056430 A1 * 3/2005 Dennistoun et al. ..... 166/321

OTHER PUBLICATIONS

Halliburton Brochure—Subsurface Flow Control Systems—section 6, pp. 30-33.
BJ Services Company Brochure—Multi-Service Valve Product Information (2 pages).

* cited by examiner

*Primary Examiner*—Shane Bomar
(74) *Attorney, Agent, or Firm*—Buskop Law Group, PC; Wendy Buskop

(57) ABSTRACT

A device for shifting a sliding sleeve. The sliding sleeve is concentrically positioned within a well, and wherein the well is in communication with a hydrocarbon reservoir. In the most preferred embodiment, the device comprises an outer housing forming an annulus with the well and a power piston slidably disposed within the outer housing. The power piston includes an upper shoulder configured to form an annular chamber and a tubular chamber relative to the outer housing, a lower shoulder configured to form an atmospheric chamber relative to the outer housing. The device further comprises a first latch for preventing upward movement of the power piston, a second latch for preventing downward movement of the power piston, and wherein movement of the power piston shifts the sliding sleeve.

23 Claims, 10 Drawing Sheets

SHIFTING APPARATUS AND METHOD

BACKGROUND OF THE INVENTION

This disclosure relates to an apparatus for shifting a valve. More specifically, but without limiting the scope of the disclosure, this disclosure relates to an apparatus and method for shifting a downhole valve from a first position to a second position, wherein the downhole valve is disposed within a well.

In the course of completing and producing hydrocarbon wells, operators find it necessary to install various components such as packers, gravel pack screens, liners, etc. As those of ordinary skill will readily recognize, one component used is a downhole valve, such as a sliding sleeve. The sliding sleeve valve generally has a sleeve member that is slidable from a first position to a second position, which generally corresponds to a closed position to an open position. Sliding sleeve valves are commercially available from Weatherford, Inc. under the name RIV.

Generally, prior art sliding sleeves use mechanical means to shift from the first position to the second position or from the second position to the first position. The shifting tools can be run into the well using a secondary work string such as wire line, tubing, and coiled tubing. The shifting tools provide a shifting force to manipulate a sleeve or mandrel in an assembly, such as an oil well completion tool. However, the use of the secondary work string poses many problems. For instance, the use of the secondary work string is expensive and time consuming. Also, the introduction of the secondary work string into the well may cause problems such as the secondary work string becoming stuck within the well.

Therefore, there is a need for an apparatus and method that will allow for an efficient shifting of a downhole valve. There is a also a need for an apparatus and method that dependably shifts a downhole valve without the need for a secondary string. Further, there is a need for a shifting device that is a separate component from the downhole valve. These needs, and many other needs, will be met by the apparatus and method herein disclosed.

SUMMARY OF THE INVENTION

A device for shifting a sliding sleeve from a first position to a second position is disclosed. The sliding sleeve is concentrically positioned within a well, and wherein the sliding sleeve contains a moveable inner member and wherein the well is in communication with a hydrocarbon reservoir. The device comprises an outer housing forming an annulus with the well and a power piston slidably disposed within the outer housing. The power piston comprises an upper shoulder configured to form an annular chamber and a tubular chamber relative to the outer housing, and a lower shoulder c configured to form an atmospheric chamber relative to the outer housing.

The device further comprises an up latch means for preventing upward movement of the power piston relative to the outer housing, a down latch means for preventing downward movement of the power piston relative to the outer housing, and wherein movement of the power piston shifts the moveable inner member from the first position to the second position. In one preferred embodiment, the down latch means comprises a shear ring insert, a first plurality of shear pins connecting the shear ring insert to the power piston, and a c-ring configured to prevent downward movement of the power piston after the first shear pins have sheared. Also, the up latch means may comprise a collet sleeve abutting the power piston, and wherein the collet sleeve includes a collet member engaging the outer housing, and an inner support member disposed within the collet member. The device may further contain a second plurality of shear pins for attaching the collet sleeve to the outer housing.

In one embodiment, the device includes an annular passage communicating the annulus to the annular chamber, and an inner bore passage communicating the inner bore to the tubular chamber. In one embodiment, the sliding sleeve is connected to production screen, and wherein the production screen is placed adjacent a hydrocarbon reservoir in the well. Also, in one embodiment, the outer housing is connected to a coiled tubing string, and wherein the coiled tubing string is placed concentrically within the well.

Also disclosed is a method of shifting a sliding sleeve valve from a first position to a second position, and wherein the sliding sleeve is positioned within a well. The method comprises providing an activating device operatively attached to the sliding sleeve valve, the activating device including: an outer housing forming an annulus with the well; a power piston disposed within the outer housing, and wherein the power piston includes an upper shoulder configured to form an annular chamber and a tubular chamber, and a lower shoulder configured to form an atmospheric chamber. The activating device further includes a collet member engaging the outer housing, an inner support member disposed within the collet member, a shear ring insert, and shear pins connecting the shear ring insert to the upper piston. In the preferred embodiment, the downhole valve contains a moveable inner member and wherein movement of the power piston shifts the moveable inner member from the first position to the second position.

The method further includes lowering the sliding sleeve valve and attached activating device into the well on a work string. The power piston is prevented from moving upward via the collet member, and additionally, the power piston is prevented from moving downward via a snap engaging the power piston. The method further includes performing a well intervention technique on the well.

The collet member is shifted upward. The method further comprises pressuring the tubular chamber of the activating device, shearing the shear pins that connected the shear ring insert to the power piston, and moving the power piston upward into engagement with the collet member. The method further includes disengaging the snap ring from the power piston so that the snap ring is allowed to slide along the power piston, capturing the snap ring within a groove on the power piston and releasing the applied pressure to the tubular chamber of the activating device. Next, the annular chamber is expanded relative to the atmospheric chamber thereby allowing the power piston to move downward, and the sliding sleeve valve is moved from the first position to the second position.

In the most preferred embodiment, the step of pressuring the internal bore includes applying pressure to an internal passage and into the tubular chamber and the step of expanding the annular chamber includes allowing an annulus pressure into an annular passage and into the annular chamber. Also, the step of moving the sliding sleeve valve from the first position to the second position includes abutting an end of the power piston against an end of the moveable inner member so that the power piston shifts the sliding sleeve valve from the first position to the second position. In one preferred embodiment, the sliding sleeve valve is run into the well on a coiled tubing string. Additionally, the step of performing the well intervention technique includes gravel packing the well.

An advantage of the present apparatus is that it insures full movement of the sliding sleeve to the open position. Another advantage is that most hydrocarbon well completion equipment that relies on hydraulic mechanisms has a hydraulic operator which cannot be separated from the main tool; the present apparatus is designed to be a separate component from the sliding sleeve valve.

Yet another advantage is that the present shifting apparatus is designed to replace wireline, tubing, and/or coiled tubing conveyed shifting tools that provide shifting force to manipulate a sleeve or mandrel in a hydrocarbon well completion tool. The present apparatus eliminates the need for a wireline, concentric string, or coil tubing operation to deliver the shifting force to the sliding sleeve.

A feature of the present invention includes the three (3) chambers that are configured to assist in delivering the force necessary to move the sleeve from a first position to a second position. The three chambers include the atmospheric, annular, and tubular chambers. Another feature includes a power piston that is operatively associated with the atomospheric, annular and tubular chamber. Yet another feature are the latching mechanisms that selectively latch the power piston in place. The latching mechanisms include use of a collet member, a shear ring insert and a snap ring member.

DETAILED DESCRIPTION OF THE PREFERRED EMBODIMENTS

Figure 1A:
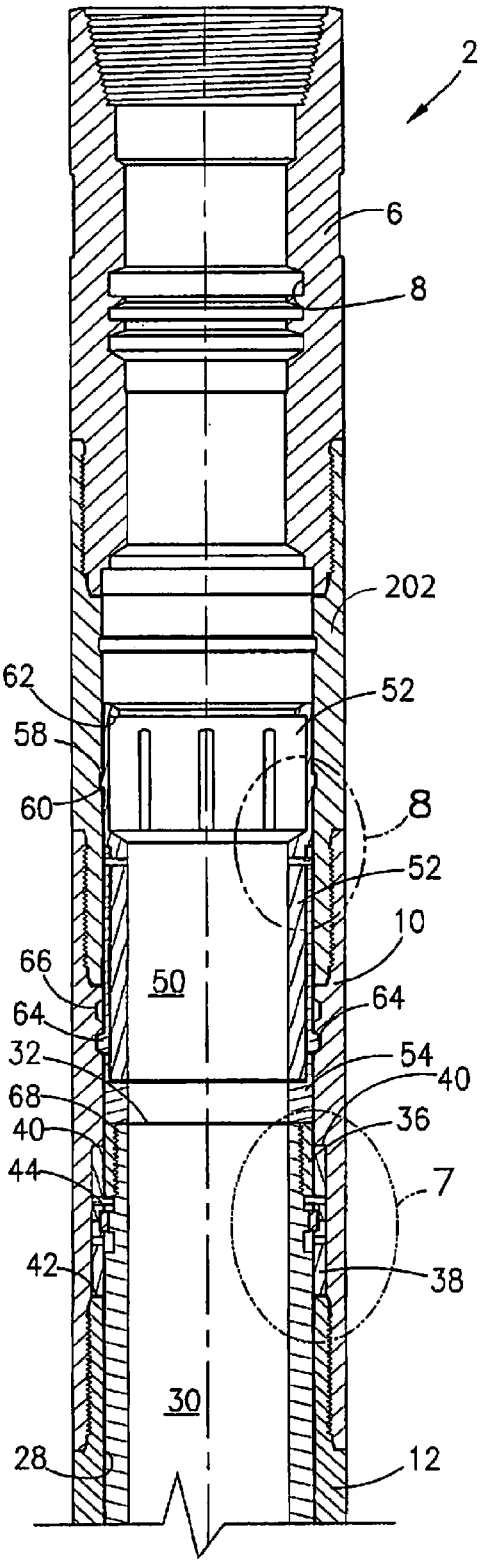
FIGS. 1A-1D are a partial cross-sectional view of the most preferred embodiment of the shifting apparatus of the present invention operatively attached to a sliding sleeve in the run in position.

Referring collectively now to FIGS. 1A-1*d*, a partial cross-sectional view of one embodiment of the shifting apparatus 2 of the present invention operatively attached to a sliding sleeve 4 in the run in position. The shifting apparatus 2 includes the cylindrical top sub 6 with an internal nipple profile 8. The top sub 6 removably connects to a top housing 202 which engages to the cylindrical upper housing 10 which in turn extends to the cylindrical upper intermediate housing 12, and wherein the intermediate housing 12 is removably connected to the cylindrical lower intermediate housing 14, which in turn is removably connected to the cylindrical upper intermediate housing 12, and wherein the intermediate housing 12 is removably connected to the cylindrical lower intermediate housing 14, which in turn is removably connected to the cylindrical lower housing 16. The lower housing 16 is removably connected to the cylindrical adapter 18, and wherein the cylindrical adapter is connected to the sliding sleeve 4. It should be noted that the various housings, in the preferred embodiment, will be connected via thread means, well known in the art.

The sliding sleeve 4 has an outer member 20 having ports 22 and a moveable inner member 24 containing slots 26, and wherein in a first position the slots 26 are isolated from the ports 22 and therefore there is no communication from the inner bore portion to the outer portion of the sliding sleeve 4, and in a second position, the slots 26 are essentially aligned with the ports 22 which allows communication from the inner bore portion to the outer portion of the sliding sleeve 4 Sliding sleeve valves are commercially available form Weatherford, Inc. under the name RIV. A sliding sleeve valve was disclosed in patent application Ser. No. 10/875,411, filed on 24 Jun. 2004, entitled "Valve Apparatus with Seal Assembly", which is incorporated herein by express reference.

The shifting apparatus 2 has an internal bore, seen generally at 28, and slidably disposed within the bore 28 is the power piston 30. The power piston 30 has a first end 32 (seen generally in FIG. 1A) and a second end 34 (seen generally in FIG. 1C). At the first end 32 is the upper push piston nut 36 that will be threadedly connected to the first end 32. A shear ring insert 38 is fitted between the shoulder 40 on the housing 10 and the radial end 42 on the housing 12, and wherein the shear ring insert 38 has shear pins, seen generally at 44, disposed therethrough connecting the upper push piston nut 36 to the shear ring insert 38. The snap ring 46 is shown engaging upper push piston nut 36 which prevents the power piston 30 from a downward movement. A groove 48 is disposed on the power piston 30, wherein the snap ring 46 will cooperate and engage with the groove 48 as will be described later.

Figure 8:
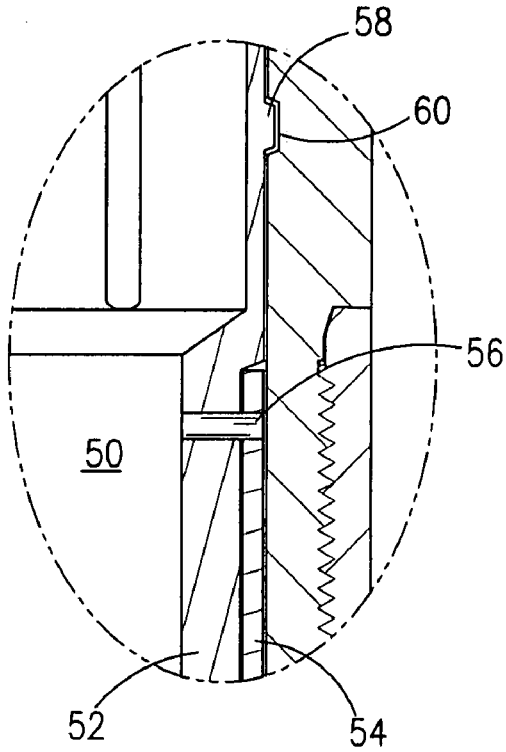
FIG. 8 is an expanded view of the area marked "8" in FIG. 1.

FIG. 1 A further depicts the collet sleeve, seen generally at 50, for preventing upward movement of the power piston 30. Referring now to FIG. 8, which is an expanded view of the area "8" in FIG. 1A, the collet sleeve 50 comprises a collet member 52 that is partially disposed within an inner support member 54, and wherein the collet member 52 is attached to the inner support member 54 via shear pin 56. The collet member 52 has the protuberance 58 that engages the internal groove 60 of the top sub 6. Returning to FIG. 1A, the collet member 52 has an inner shoulder 62 that is designed to engage a running tool that will shift the collet member 52 upward, as will be more fully discussed later in the disclosure. Additionally, FIG. 1A shows the collet sleeve 50 having a plurality of dogs 64 that engage the internal groove 66 located on the inner part of the upper housing 10. Note that in FIG. 1A, the end 68 of the upper push piston nut 36 abuts the end 70 of the inner support member 54, and therefore, the power piston 30 can not move up.

Figure 1B:
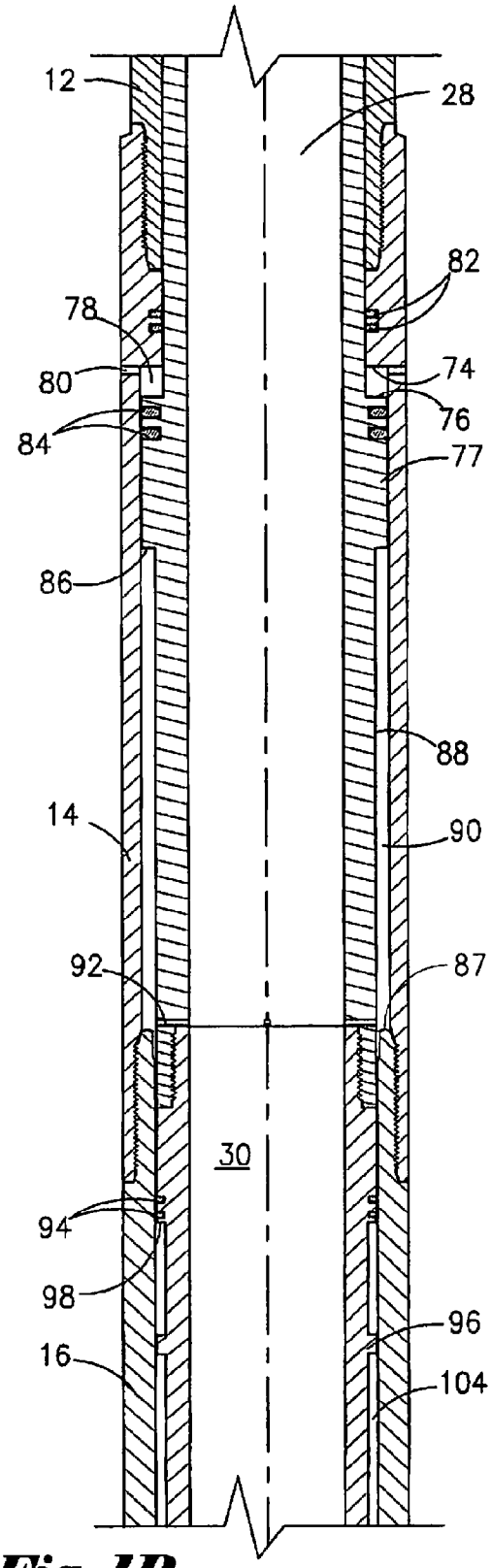

Referring specifically to FIG. 1B, the lower intermediate housing 14 has the first radial shoulder 74 that cooperates with the second radial shoulder 76 on the expanded section 77 of the power piston 30 to form the annular chamber 78. A port 80 formed in the lower intermediate housing 14 communicates the outer portion of the shifting apparatus 2 to the annular chamber 78. It should be noted that the seal means 82 formed on the inner portion of the lower intermediate housing 14 and the seal means 84 formed on the expanded section 77 of the power piston 30 cooperate to seal the annular chamber 78, as well understood by those of ordinary skill in the art.

FIG. 1B depicts the expanded section 77 extends to the third radial shoulder 86, and the fourth radial shoulder 87, and wherein the radial end 88 of the lower housing 16 and the radial shoulder 86 cooperate to form the tubular chamber 90. Hence, a pressure applied to the internal bore 28 will be communicated through the inner bore port 92 and into the tubular chamber 90. The seal means 94 on the outer portion of the power piston 30 and the seal means 84 will cooperate to seal the tubular chamber 90.

Figure 1C:
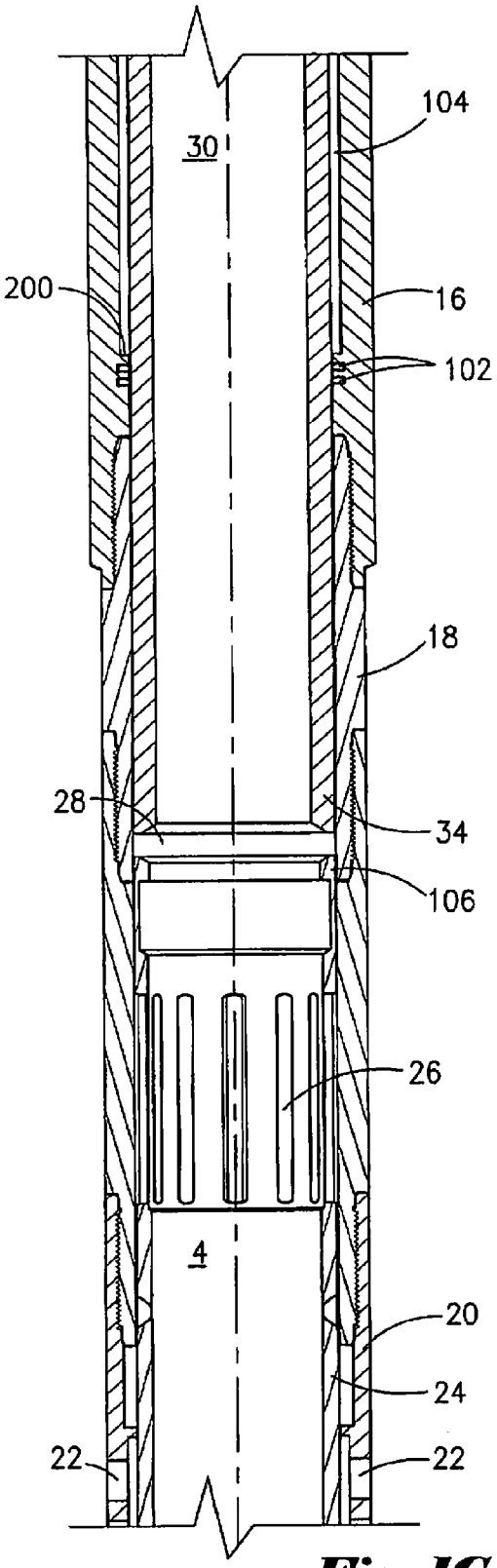

The power piston 30 has configured thereon the lower push piston 96 which is another expanded section of the power piston 30, and wherein the lower push piston 96 contains the first end shoulder 98 and the second end shoulder 200. FIG. 1C depicts the seal means 102 that are disposed on an expanded portion of the lower housing 16. As per the teachings of the present disclosure, the seal means 102 and the seal means 94, act together with the lower housing 16 and power piston 30, and cooperate to form an atmospheric chamber 104. The pressure within the atmospheric chamber 104 is sealed at the surface, and therefore, will remain at atmospheric pressure when disposed within the well The sleeve inner member 24 has the first end 106 and the second end 108. The second end 34 of the power piston 30 is configured for a gap with the first end 106 in order to move the sleeve inner member 24 from a first position to a second position, as will be more fully set out later in the description.

Figure 1D:
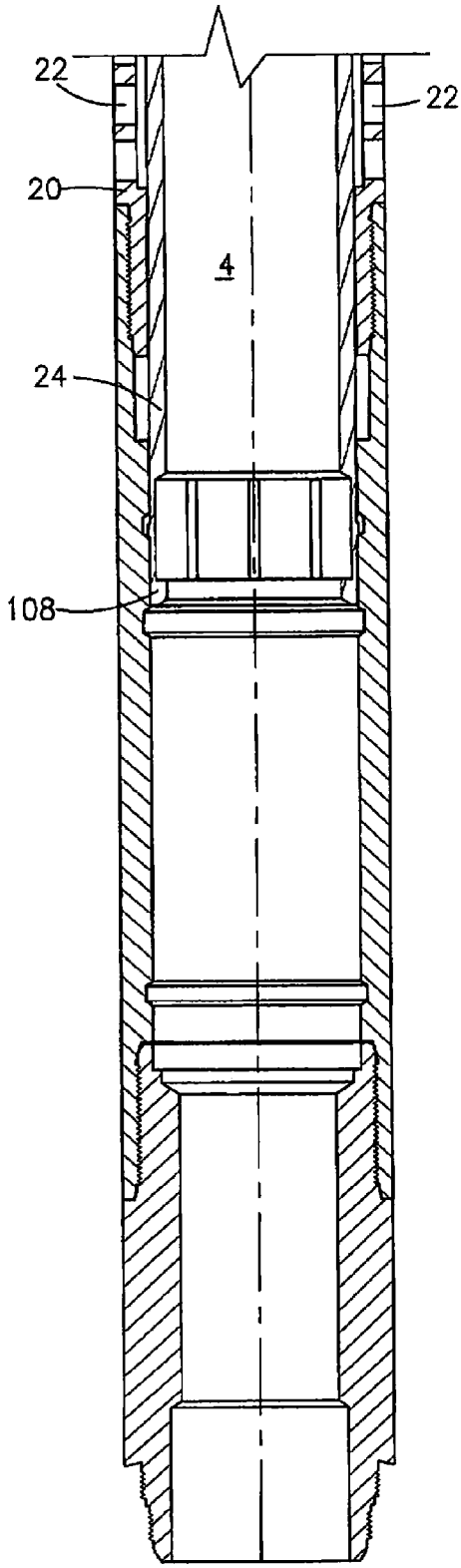
Figure 2:
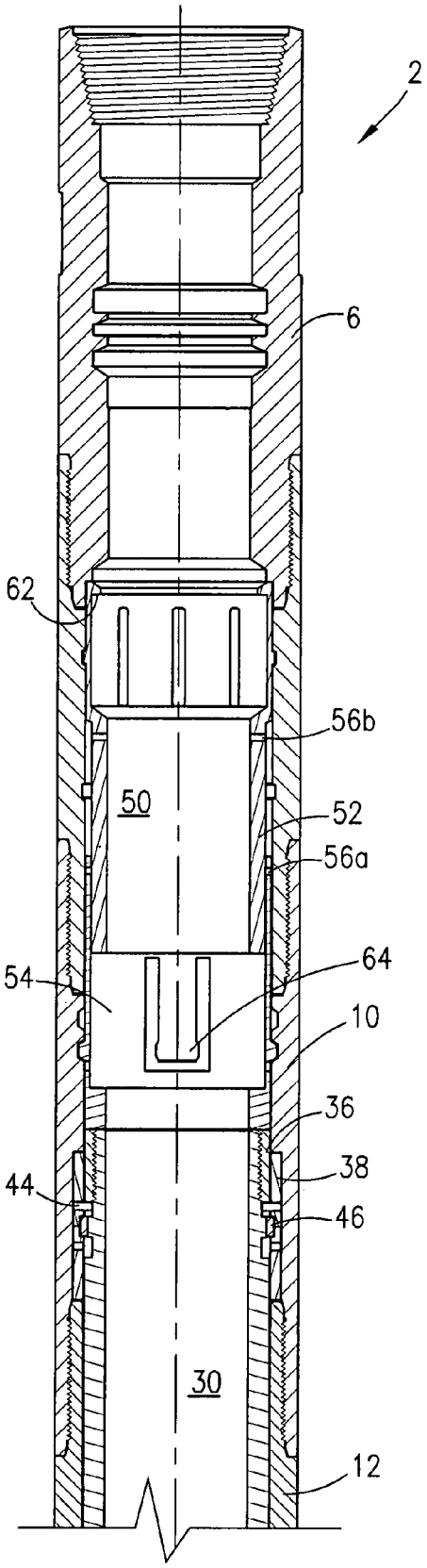
FIG. 2 is a sequential view of the shifting apparatus and sliding sleeve seen in FIGS. 1A-1D with the collet sleeve shifted upward.

FIGS. 1A-1D represent the apparatus 2 in the run-in position. In other words, the FIGS. 1A-1D represent the apparatus 2 as it is run into the well on a work string. Once the apparatus 2 reaches the desired depth, the planned well intervention work may proceed. The well intervention work may include such procedures as gravel packing, acidizing, fracturing, etc. Referring now to FIG. 2, a sequential view of the shifting apparatus 2 (which is attached to the sliding sleeve valve 4 seen in FIGS. 1A-1D) will now be described with the collet member 52 shifted upward. Hence, the operator may utilized the work string, and in particular a pulling tool (not shown) to engage the inner shoulder 62 in order to shift the collet member 52 upward. Pulling tools are commercially available from Petroquip Inc. under the name WSST-2. The shear pin 56 has been sheared (56*a*, 56*b*), and therefore, the collet member 52 is moved upward via the work string. It should be noted that like numbers appearing in the various figures refer to like components.

Figure 3A:
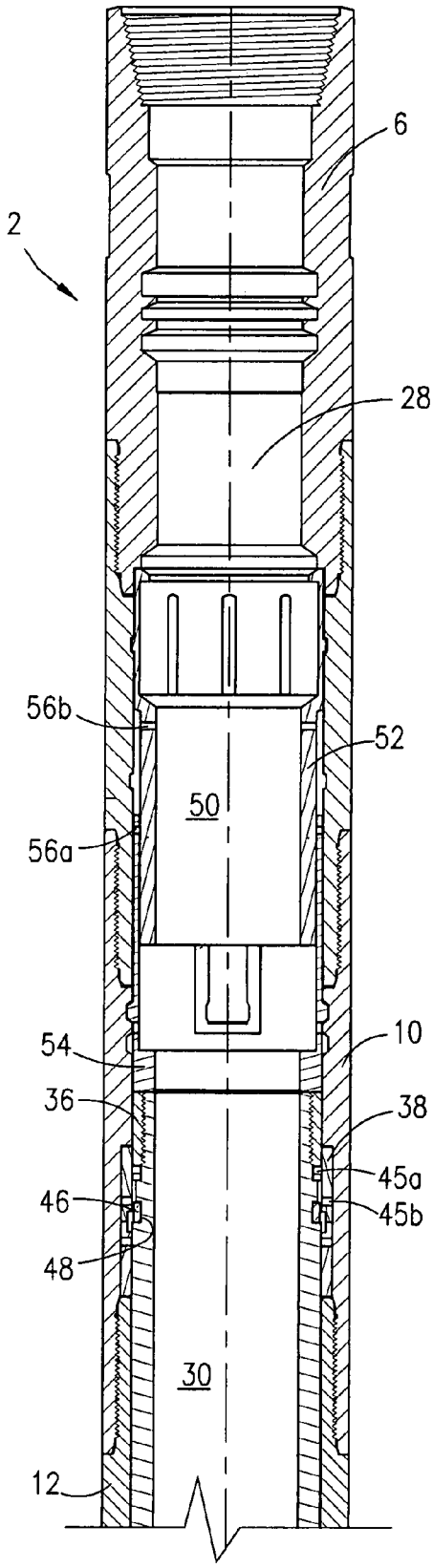
FIGS. 3A-3C are a sequential view of the shifting apparatus and sliding sleeve seen in FIGS. 1A-1C while internal tubing pressure is being applied.
Figure 3B:
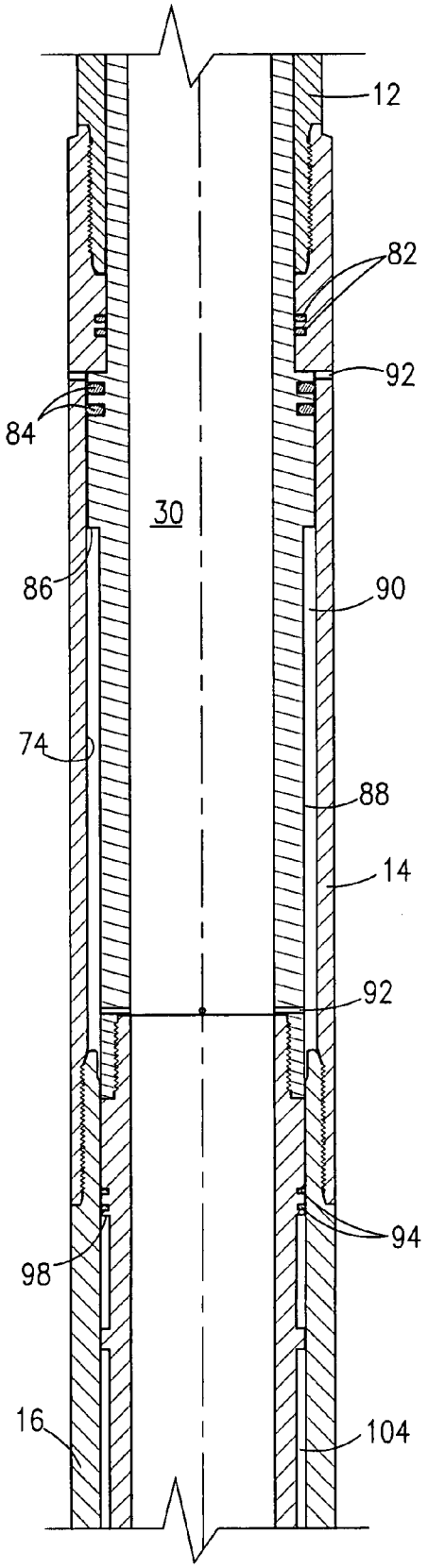
Figure 3C:
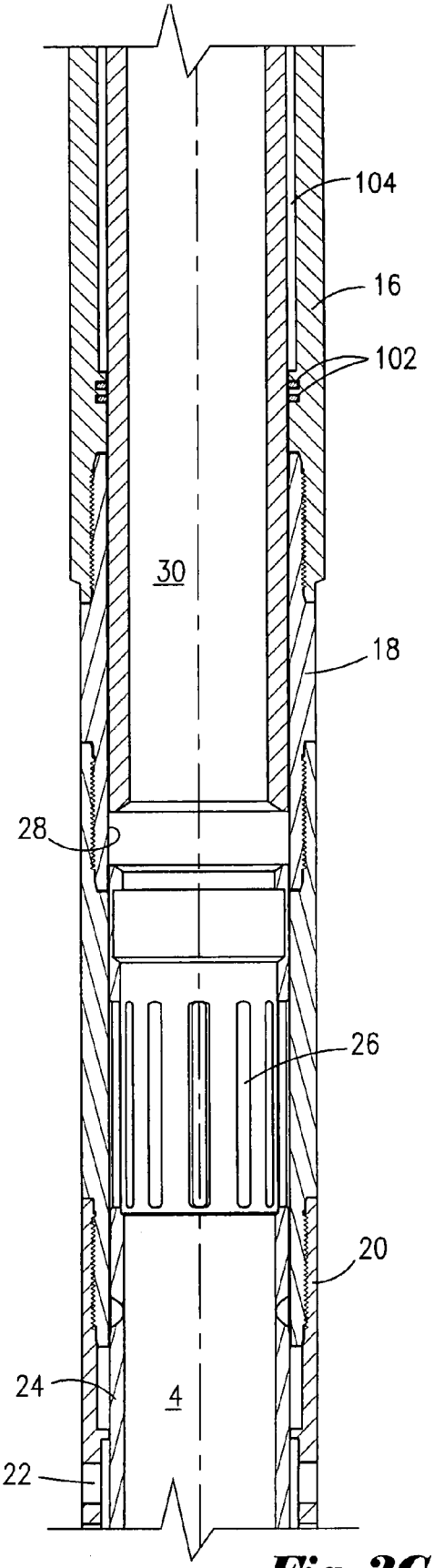
Figure 4A:
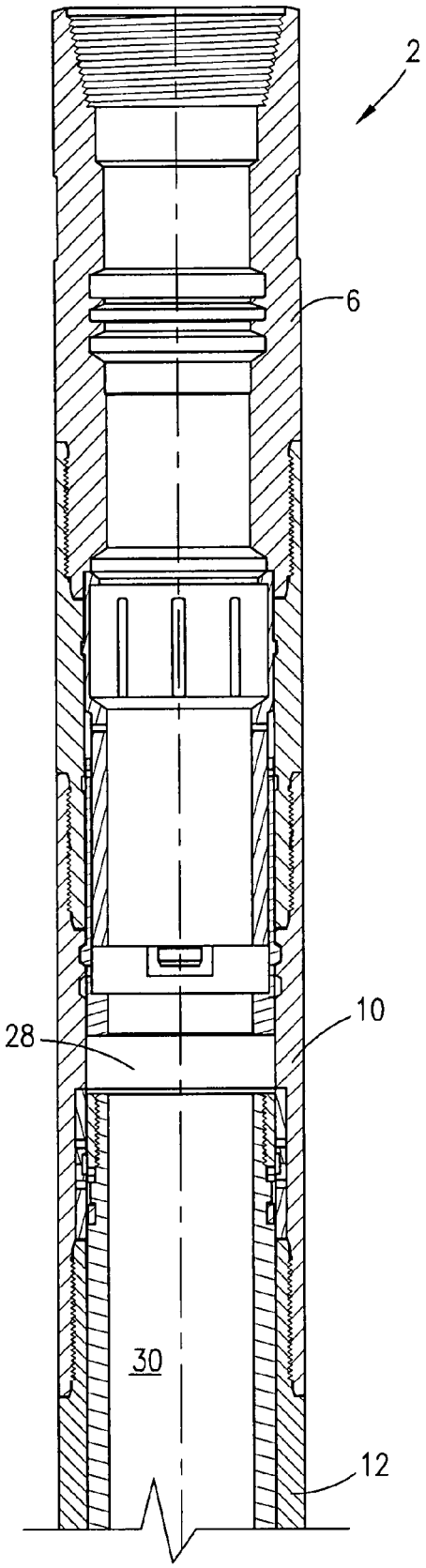
FIGS. 4A-4D are a sequential view of the shifting apparatus and sliding sleeve seen in FIGS. 3A-3C after relieving the internal tubing pressure.
Figure 4B:
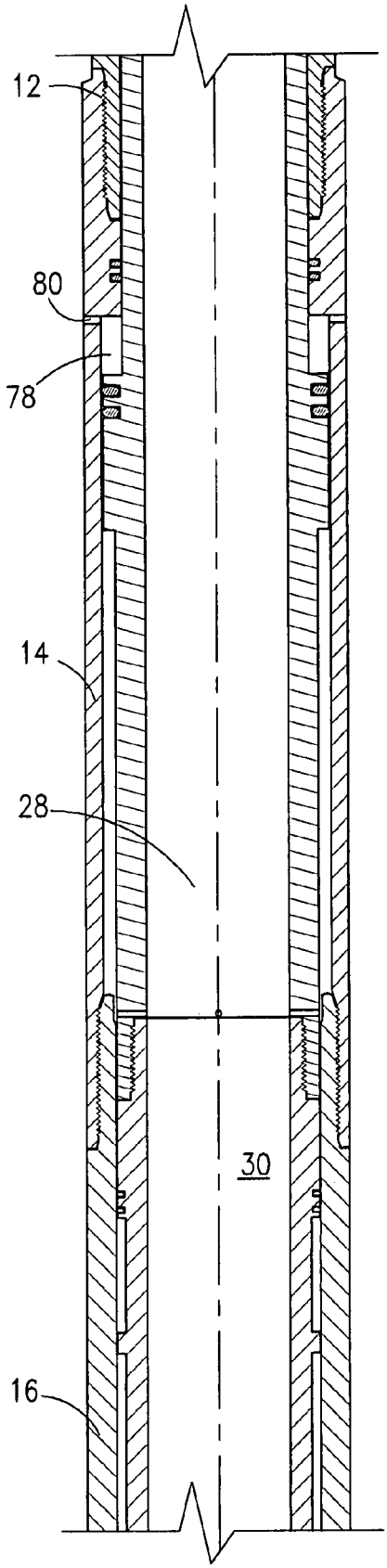
Figure 4C:
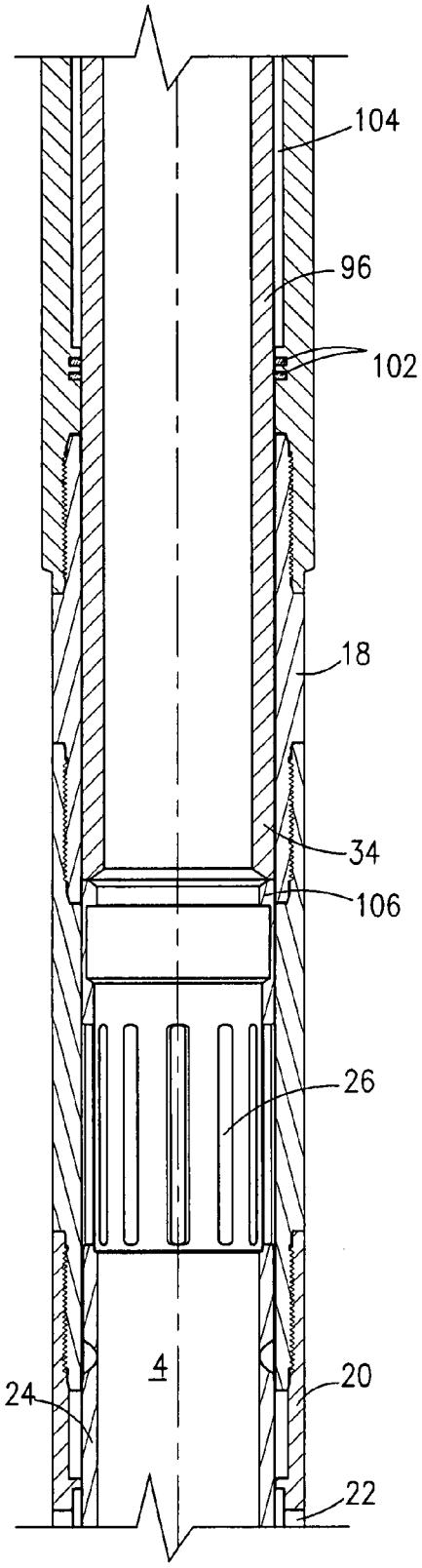
Figure 4D:
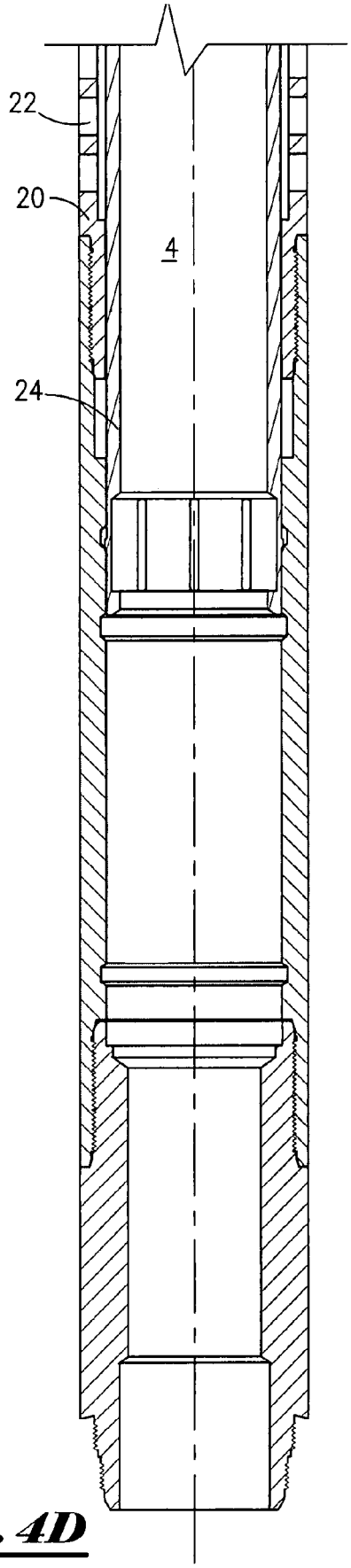
Figure 5A:
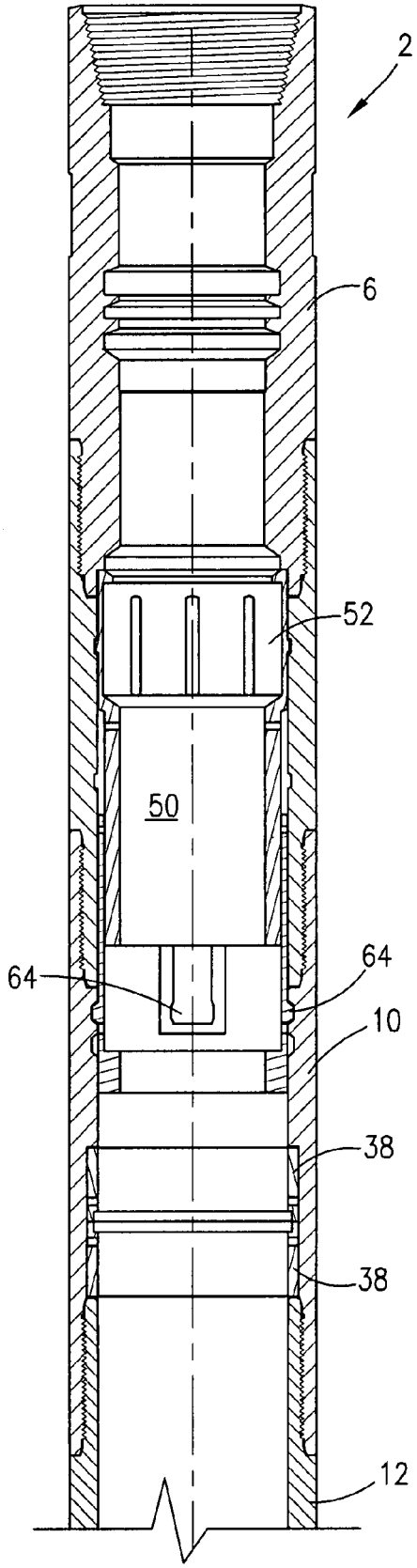
FIGS. 5A-5D are a sequential view of the shifting apparatus and sliding sleeve seen in FIGS. 4A-4D with sliding sleeve having been shifted.
Figure 5B:
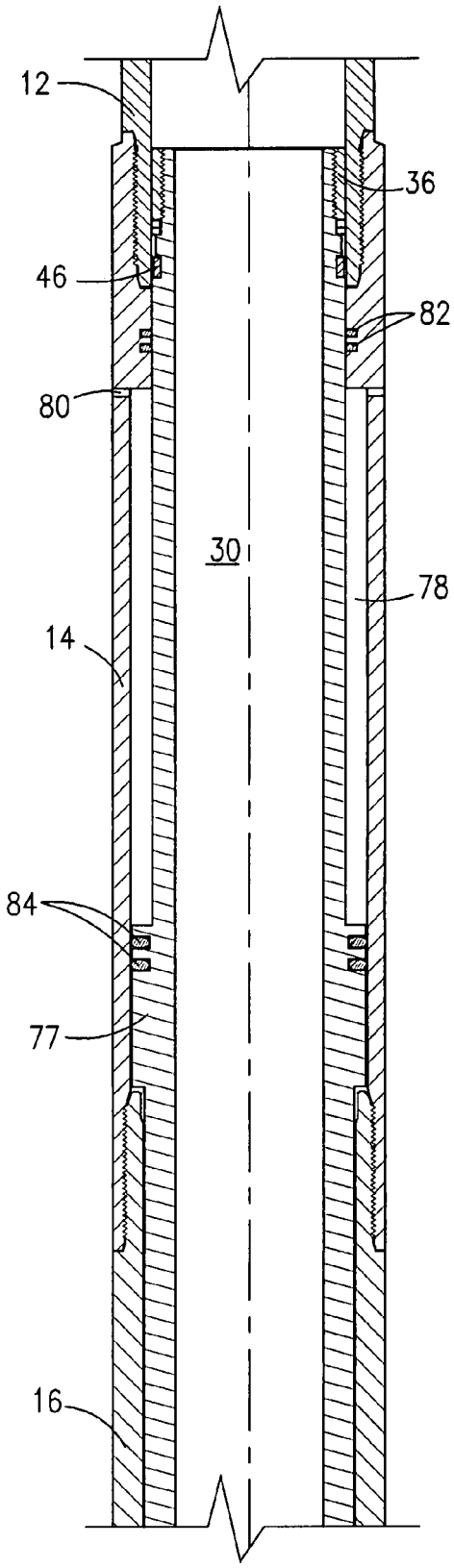
Figure 5C:
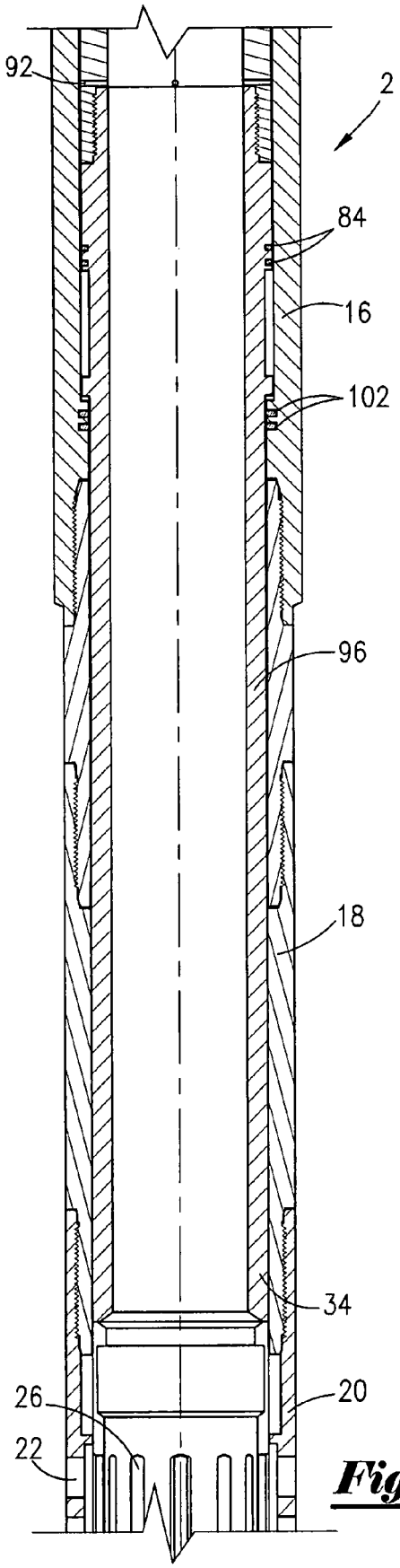
Figure 5D:
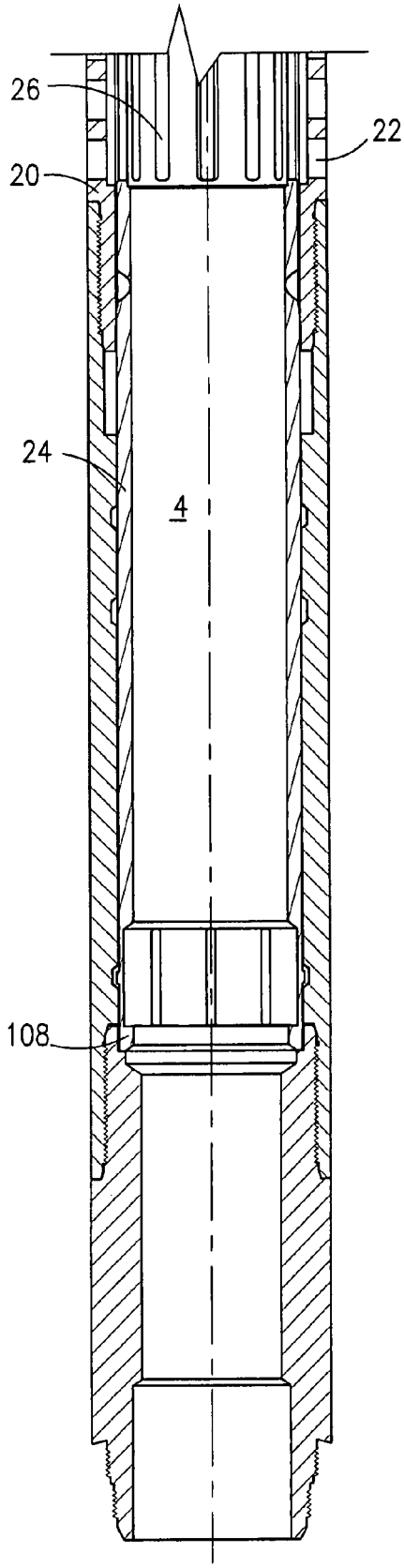

Referring now to FIGS. 3A-3C, a sequential view of the shifting apparatus 2 and sliding sleeve 4 seen in FIGS. 1C and 1D while internal tubing pressure is being applied will now be described. More specifically, the operator has pulled the pulling tool out of the well, and an internal pressure is applied to the internal bore 28 of the apparatus 2. The application of internal pressure is directed into port 92 and then into the tubular chamber 90, which in turn expands the tubular chamber 90. The shear screws 44 in the shear ring insert 38 will shear into parts 45*a*, 45*b* due to the applied force on the power piston 30. The inner support member 54 and the upper push piston nut 36 shift upwards, and wherein the c-ring 46 will ride down on the power piston 30 and ultimately, after a predetermined amount of travel, the c-ring 46 will snap into groove 48. Once the c-ring 46 snaps into the groove 48, the power piston 30 will be allowed to move downward since the c-ring 46 is no longer engaging the power piston 30.

In FIGS. 4A-4D, a sequential view of the shifting apparatus 2 and sliding sleeve 4 seen in FIGS. 3A-3D after relieving the internal tubing pressure will now be described. By relieving the pressure within the internal bore 28, the annulus pressure will enter into the annular chamber 78 via the annular port 80. The annular pressure within the annular chamber 78 will expand the chamber 78 so that the power piston 30 shifts downward into contact with the sleeve inner member 24, i.e. end 34 contacts and moves end 106.

Referring now to FIGS. 5A-5D, a sequential view of the shifting apparatus 2 and sliding sleeve 4 seen in FIGS. 4A-4D with sliding sleeve inner member 24 having shifted. Hence, the ports 22 and the slots 26 are now aligned, and the sliding sleeve is in the open position.

Figure 6:
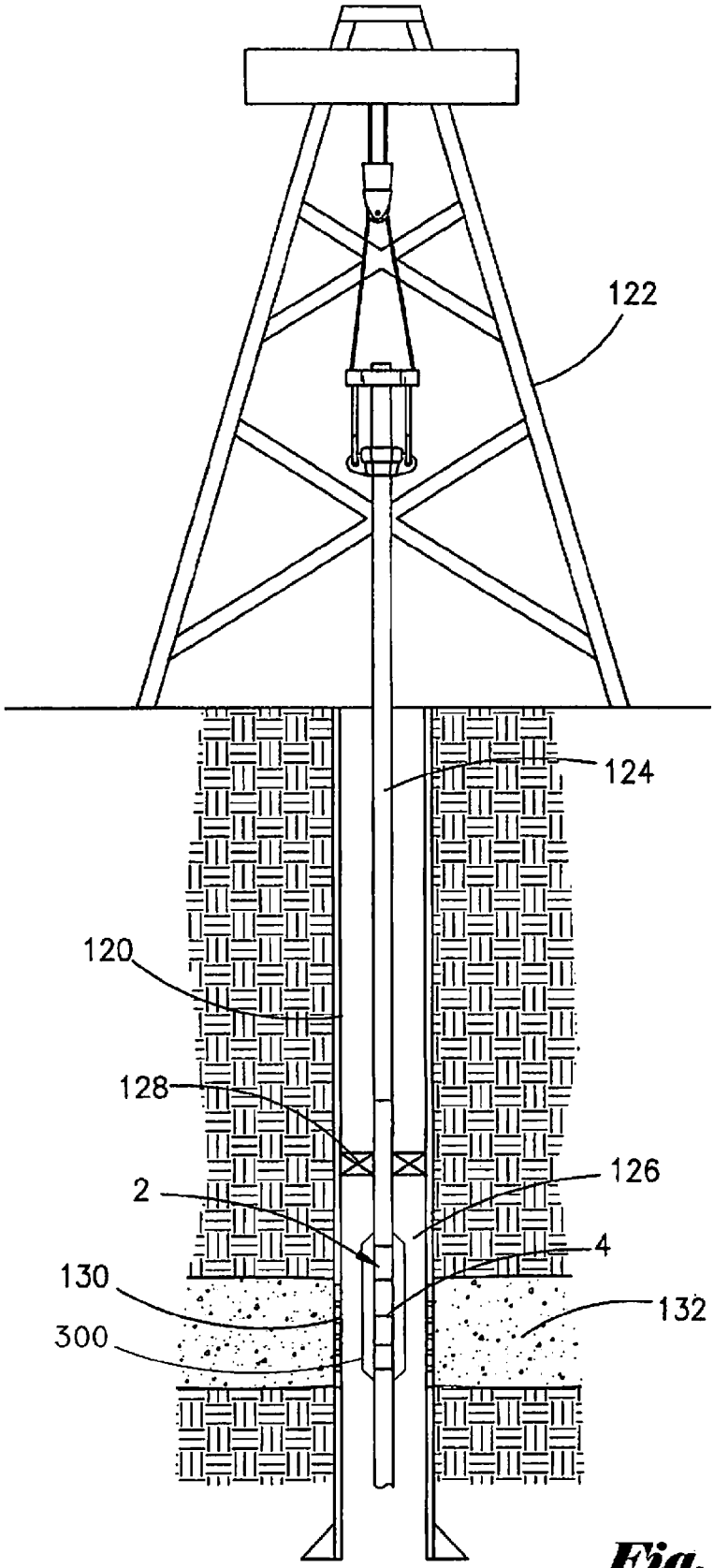
FIG. 6 is a schematic illustration of the apparatus suspended within a well from a platform.
Figure 7:
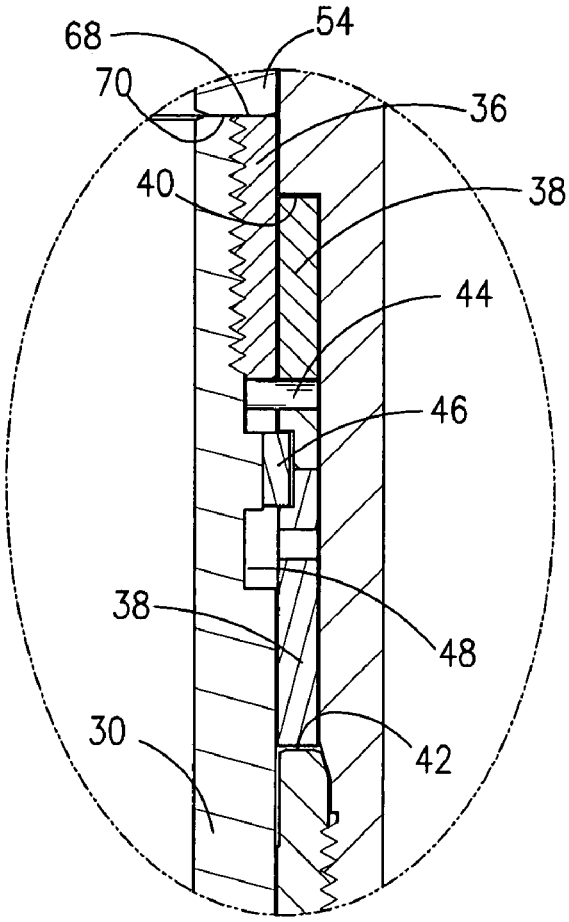
FIG. 7 is an expanded view of the area marked "7" in FIG. 1.

FIG. 6 is a schematic illustration of the shifting apparatus 2 suspended within a well 120 from a drilling rig 122. The shifting apparatus 2 is operatively attached to the sliding sleeve as previously described. The shifting apparatus 2 is also operatively attached at the other end to a work string 124, and wherein the work string 124 may be a drill string, tubular, or coiled tubing string. The outer portion of the work string 124 and the inner portion of the well form an annulus 126. FIG. 6 also depicts a packer means 128 that has been set in the well 120, and wherein the packer means 128 is operatively attached to the work string 124, and wherein the packer means 128 generally sealingly engages the inner portion of the well 120. In one preferred embodiment, the well 120 has perforations 130 in the well 120 communicating an inner portion of the well 120 with a hydrocarbon reservoir 132. Thus, in accordance with the teachings of the present invention, the sliding sleeve 4 will be moved from a first position to a second position. A production screen 300 is depicted connected to the sliding sleeve 4 adjacent to the hydrocarbon reservoir 132.

Changes and modifications in the specifically described embodiments can be carried out without departing from the scope of the invention which is intended to be limited only by the scope of the appended claims and any equivalents thereof.

We claim:

1. A shifting apparatus for opening a downhole valve, the valve being concentrically positioned within a well, and wherein the valve contains a movable inner member, the apparatus comprising:

an outer housing forming an annulus with the well, wherein the outer housing comprises: a cylindrical top sub, a cylindrical top housing removably connected to the cylindrical top sub, a cylindrical upper housing removably connected to the cylindrical top housing, a cylindrical upper intermediate housing removably connected to the cylindrical upper housing, a cylindrical lower intermediate housing comprising a first radial shoulder, the cylindrical lower intermediate housing is removably connected to the cylindrical upper intermediate housing, a cylindrical lower housing comprising a fourth radial shoulder and a second end shoulder, the cylindrical lower housing is removably connected to the cylindrical lower intermediate housing, and the cylindrical lower housing is removably connected to a cylindrical adapter;

wherein the cylindrical adapter is removably connected to a sliding sleeve;

a power piston disposed within the outer housing, wherein the power piston comprises: a second shoulder forming an annular chamber with the first radial shoulder, and a third radial shoulder forming a tubular chamber with the fourth radial shoulder relative to the outer housing; and further, the power piston has a first end shoulder configured to form an atmospheric chamber relative to the outer housing with the second end shoulder; wherein the atmospheric chamber is sealed at an atmospheric pressure level;

wherein internal tubing pressure can be applied to the tubular chamber;

a collect sleeve abutting the power piston prevents upward movement of the power piston relative to the outer housing, until the internal tubing pressure applied to the tubular chamber exceeds an annulus pressure in the annular chamber, wherein the collet sleeve is movable upwardly;

a snap ring disposed on the power piston prevents downward movement of the power piston relative to the outer housing, wherein the snap ring is disengagable from a shear ring insert disposed within the cylindrical upper housing when the power piston moves the collet sleeve upwardly;

and wherein movement of the power piston shifts an inner support member disposed within the cylindrical upper housing from a closed position to an open position, after the collet sleeve is moved upwardly.

2. The apparatus of claim 1 wherein said collet sleeve comprises: a collet member engaging the outer housing.

3. The apparatus of claim 2 wherein a first shear pin means connects the shear ring insert to the power piston, and the snap ring is configured to engage the power piston to prevent downward movement after the first shear pin means has been sheared.

4. The apparatus of claim 3 further comprising: an annular passage communicating the annulus to the annular chamber.

5. The apparatus of claim 4 further comprising: an inner bore passage communicating an inner bore to the annular chamber.

6. The apparatus of claim 5 further comprising: second shear pin means for attaching said collet sleeve to said outer housing.

7. The apparatus of claim 6 wherein the well is completed to a hydrocarbon reservoir and wherein said valve is connected to a production screen placed adjacent the hydrocarbon reservoir in the well.

8. The apparatus of claim 6 wherein said outer housing is connected to a coiled tubing string, wherein said coiled tubing string is placed concentrically within the well.

9. A device for shifting a sliding sleeve from a first position to a second position, the sliding sleeve being concentrically positioned within a well, and wherein the sliding sleeve contains a moveable inner member and wherein the well is in communication with a hydrocarbon reservoir, the device comprising an outer housing forming an annulus with the well, wherein the outer housing comprises: a cylindrical top sub, a cylindrical top housing removably connected to the cylindrical top sub, a cylindrical upper housing removably connected to the cylindrical top housing, a cylindrical upper intermediate housing removably connected to the cylindrical upper housing, a cylindrical lower intermediate housing comprising a first radial shoulder, the cylindrical lower intermediate housing is removably connected to the cylindrical upper intermediate housing, a cylindrical lower housing comprising a fourth radial shoulder and a second end shoulder, the cylindrical lower housing is removably connected to the cylindrical lower intermediate housing, and the cylindrical lower housing is removably connected to a cylindrical adapter;

wherein the cylindrical adapter is removably connected to a sliding sleeve;

a power piston slidably disposed within the outer housing, and wherein the power piston comprises: a second shoulder forming an annular chamber with the first radial shoulder, and a third radial shoulder forming a tubular chamber with the fourth radial shoulder relative to the outer housing; and further, the power piston has a first end shoulder configured to form an atmospheric chamber relative to the outer housing with the second end shoulder; wherein the atmospheric chamber is sealed at an atmospheric pressure level;

wherein internal tubing pressure can be applied to the tubular chamber;

an up latch means for preventing upward movement of said power piston relative to said outer housing;

a down latch means for preventing downward movement of said power piston relative to said outer housing;

and wherein downward movement of the power piston shifts the moveable inner member from the first position to the second position.

10. The device of claim 9 wherein said down latch means comprises: a shear ring insert, and a first plurality of shear pins connecting the shear ring insert to said power piston and a snap ring configured to prevent downward movement of the power piston after said first plurality of shear pins have sheared.

11. The device of claim 10 wherein said up latch means is a collet sleeve abutting the power piston relative to the outer housing, until the pressure applied to the tubular chamber exceeds a pressure in the annular chamber, wherein the collet sleeve is movable upwardly.

12. The device of claim 11 wherein said collet sleeve comprises: a collet member engaging the outer housing; and, an inner support member disposed within said collet member.

13. The device of claim 12 further comprising: an annular passage communicating the annulus to the annular chamber.

14. The device of claim 13 further comprising: an inner bore passage communicating an inner bore of the power piston to the annular chamber.

15. The device of claim 14 further comprising: a second plurality of shear pins for attaching said collet sleeve to said outer housing.

16. The device of claim 12 wherein said valve is connected to a production screen, wherein said production screen is placed adjacent the hydrocarbon reservoir in the well.

17. The device of claim 16 wherein said outer housing is connected to a coiled tubing string, wherein said coiled tubing string is placed concentrically within the well.

18. A method of shifting a sliding sleeve valve from a first position to a second position, the sliding sleeve being positioned within a well, the method comprising:

providing an activating device operatively attached to the sliding sleeve valve, the activating device including: an outer housing forming an annulus with the well; a power piston disposed within said outer housing, and wherein said power piston comprising: an upper shoulder configured to form an annular chamber and a tubular chamber; and a lower shoulder configured to form an atmospheric chamber; a collet member engaging the outer housing; and inner support member disposed within said collet member; a shear ring insert, shear pins connecting the shear ring insert to said upper piston; and where the sliding sleeve valve contains a moveable inner member and wherein movement of the power piston shifts the moveable inner member from the first position to the second position;

lowering the sliding sleeve valve and attached activating device into the well on a work string;

preventing upward movement of the power piston via said collet member;

preventing downward movement of the power piston via a snap ring engaging the power piston;

performing a well intervention technique on the well;

shifting the collet member upward;

pressuring an internal bore of the activating device;

shearing the shear pins that connected the shear ring insert to said power piston;

moving the power piston upward into engagement with the collet member;

moving the inner support member upward;

disengaging a snap ring disposed about the power piston so that the snap ring is allowed to slide along the power piston;

capturing the snap ring within a groove on the power piston;

releasing the applied pressure to the internal bore of the activating device;

expanding the annular chamber relative to the atmospheric chamber thereby allowing the power piston to move downward;

engaging the power piston with the sliding sleeve valve;

moving the sliding sleeve valve from the first position to the second position.

19. The method of claim 18 wherein the step of pressuring the internal bore included applying pressure to an internal passage and into the tubular chamber.

20. The method of claim 19 wherein the step of expanding the annular chamber includes allowing an annulus pressure into an annular passage and into the annular chamber.

21. The method of claim 20 wherein the step of moving the sliding sleeve valve from the first position to the second includes abutting an end of said power piston against an end of said moveable inner member so that the power piston shifts the sliding sleeve valve from the first position to the second position.

22. The method of claim 21 wherein the sliding sleeve valve is run into the well on a coiled tubing string.

23. The method of claim 21 wherein the step of performing the well intervention technique included gravel packing the well.

* * * * *